United States Patent [19]

Momberg

[11] 4,062,430

[45] Dec. 13, 1977

[54] QUICK RELEASE CORD STORAGE HOOK

[75] Inventor: James W. Momberg, Stamford, Conn.

[73] Assignee: Consolidated Foods Corporation, Old Greenwich, Conn.

[21] Appl. No.: 770,886

[22] Filed: Feb. 22, 1977

[51] Int. Cl.[2] ..... H02G 11/00

[52] U.S. Cl. ..... 191/12 R; 15/DIG. 10; 24/230.5 AD; 242/85.1; 248/304

[58] Field of Search ..... 191/12 R; 248/227, 304, 248/305, 306; 24/230.5 AD, 73 HH, 73 HR; 242/85.1; 15/DIG. 10

[56] References Cited

U.S. PATENT DOCUMENTS

| | | | |
|---|---|---|---|
| 1,968,884 | 8/1934 | Gilbert | 15/DIG. 10 |
| 2,003,147 | 5/1935 | Holm-Hansen | 242/85.1 |
| 2,193,989 | 3/1940 | Smellie | 242/85.1 |

*Primary Examiner*—George E. A. Halvosa
*Assistant Examiner*—Reinhard J. Eisenzopf
*Attorney, Agent, or Firm*—William S. Henry

[57] ABSTRACT

In accordance with the present invention, there is provided an improved hook for use on an electrical appliance such as an upright vacuum cleaner or floor polisher, around which may be wound or looped the electric cord for storing the latter when the appliance is not in use, but which may be moved so as to quickly release all turns but one of the cord.

6 Claims, 7 Drawing Figures

QUICK RELEASE CORD STORAGE HOOK

BACKGROUND OF THE INVENTION

It has long been known to provide a cord-retaining hook which may be moved to quickly release all turns of the stored cord and such devices are disclosed in U.S. Pat. No. 2,003,147 of May 28, 1935 to Holm-Hansen and U.S. Pat. No. 2,193,989 of Mar. 19, 1940 to Smellie. However, the known devices make no provision for and are not capable of retaining one turn of the cord.

SUMMARY OF THE INVENTION

The invention involves a compound hook which is movably secured to the upper part of the propelling handle of an upright vacuum cleaner, floor polisher or sander, rug scrubber, lawn mower or other electrically operated appliance which is provided with a manipulating handle for propelling the appliance over a horizontal surface, such as a floor or the ground. The hook is provided with two oppositely extending arms, one of which is of sufficient length and so located as to retain, when in one position, all of the turns of an electric cord looped or wound therearound, but which will release these turns when the hook is moved to another position. The other arm of the hook is shorter and so formed and positioned as to catch and retain the first turn only of the looped cord when the hook is moved to the last-mentioned position. This is desirable because the motor or the like to which the cord supplied current is usually located near the lower end of the appliance and hence the cord emerges from the lower part of the housing of the device, but it is highly desirable that the last point of attachment to the appliance when in use be as high as possible so as to avoid entanglement with the operator's feet.

Figure 1:
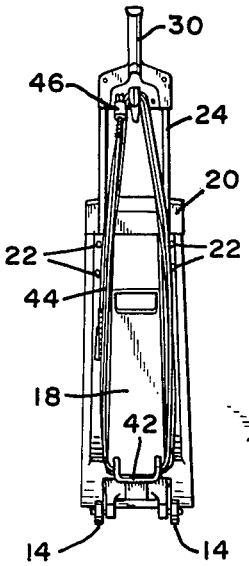
FIG. 1 is a rear view of an upright vacuum cleaner showing the electric cord neatly wound around a fixed lower hook and a movable upper compound hook.

Referring to the drawings, reference character 10 designates generally a housing adapted to be supported on the surface 12 which is to be cleaned. The bottom wall of housing 10 is formed with an elongated suction nozzle opening extending transversely adjacent to its forward edge, and the rear of the housing is supported by a pair of wheels 14. An electric motor driving a suction fan is mounted within the housing.

Pivotably secured to the rear of housing 10 is a rigid container 18 having a hinged cover 20 which may be opened for the insertion and removal of a dust bag, preferably of the disposable paper type. Through suitable internal channeling, the suction fan in housing 10 draws air in through the nozzle opening in the bottom wall, through the dust bag in container 18, and thence to the fan from which it is discharged to atmosphere. Dirt removed from surface 12 is entrained with the air entering through the suction opening and is filtered therefrom by, and retained in, the dust bag within container 18.

Removably secured to the upper end of container 18 by means of screws 22 is a forked manipulating handle 24, it being removable chiefly for convenience in packing. Secured to the upper end of the fork is a member 26 which has a lower flat portion 28 from the upper edge of which extends a hand grip 30, which is grasped by the operator when manipulating the vacuum cleaner over the surface 12. Mounted on the rear face of portion 28 near the lower edge thereof is a compound or double hook member designated generally by reference character 32. This member includes a hub 34 which is rotatable in portion 28, a first arm 36 extending at right angles in one direction from the outer end of the knob and a second arm 38 extending at right angles, but in the opposite direction, from an intermediate point on the hub nearer to portion 28. Arm 38 has an outer convex surface and is formed with a curved end 40 which, when the double hook 32 is in the position shown in FIGS. 5 and 7, extends quite close to the surface of portion 28, but which extends below the portion 28 when in the position shown in FIGS. 4 and 6.

A fixed hook-like member 42 extends downwardly from the rear lower end of container 18. An electric cord 44 for supplying current to the fan motor in housing 10 emerges from container 18 about half way up and is provided with a male plug 46 which is inserted in a convenient wall receptacle while the cleaner is in use. When it is desired to store the cord on the cleaner, the plug 46 having been removed from the receptacle, the compound hook 32 is turned to the position shown in FIGS. 1, 3, 4, and 6, and the cord 44 is wound several turns around the hook formed by hub 34 and arm 36, which now extends upwardly, and the fixed lower hook 42 and secured by engaging the usual resilient clamp on the plug 46 to a turn of the cord, as shown in FIG. 1. The space between the arm 36 and portion 28 is sufficient to accommodate the number of turns necessary to store the entire length of the cord.

Figure 3:
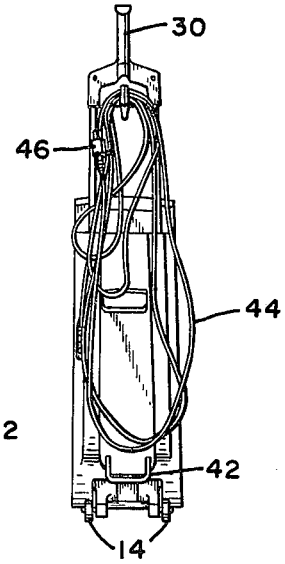
FIG. 3 is a view similar to FIG. 1, but showing the cord draped in a rather untidy manner around only the upper compound hook, which is in the same position as in FIG. 1.

It is not essential that the cord 44 be wound around both the upper and lower hooks, as just described, but it simply may be draped over the upper hook, as shown in FIG. 3, if one does not object to the somewhat untidy appearance and the fact that the loose turns might catch on objects, such as furniture, when the cleaner is being stored away or taken out of storage.

Figure 2:
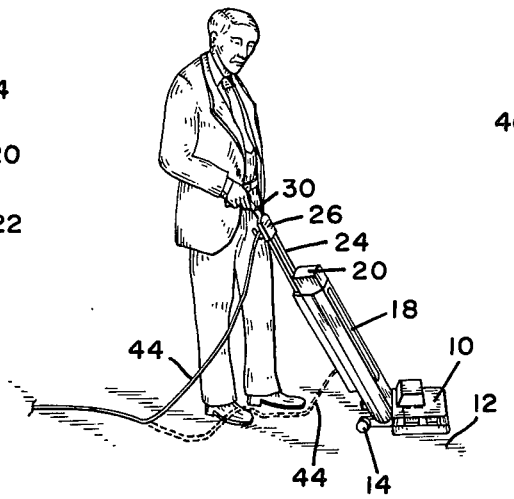
FIG. 2 is a side view on a reduced scale of the cleaner shown in FIG. 1, but with the body and handle in the inclined position in which it occupies during use and with the upper compound hook moved to a position releasing all but one turn of the cord.
Figure 5:
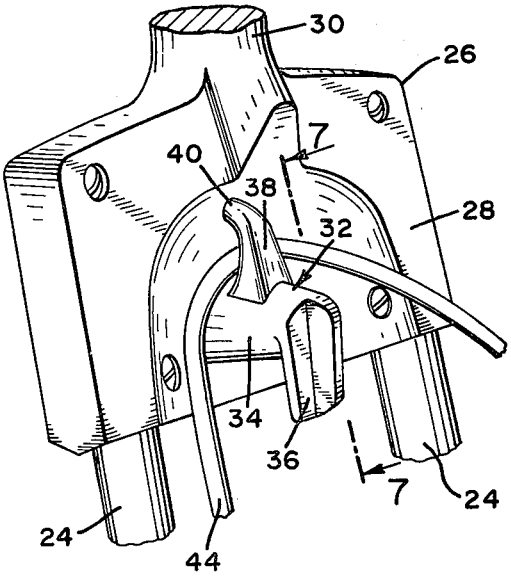
FIG. 5 is a perspective view on an enlarged scale of the upper compound hook in the position shown in FIG. 2.
Figure 7:
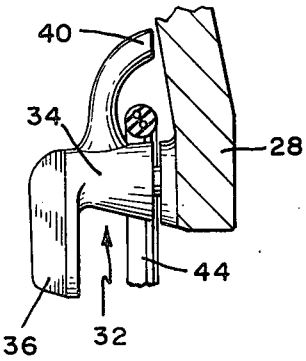
FIG. 7 is a cross-sectional view taken on the line 7—7 of FIG. 5.

When the cord is to be released from its stored position, as shown in either FIGS. 1 or 3, the plug 46 is unclamped from the turn to which it was attached and the compound hook is turned 180° to the position shown in FIGS. 2, 5, and 7. This releases all the turns from engagement by arm 36 without the necessity of unwinding the cord turn by turn, and as soon as the turns are released from the compound hook, they will fall away from the lower fixed hook 42.

Figure 4:
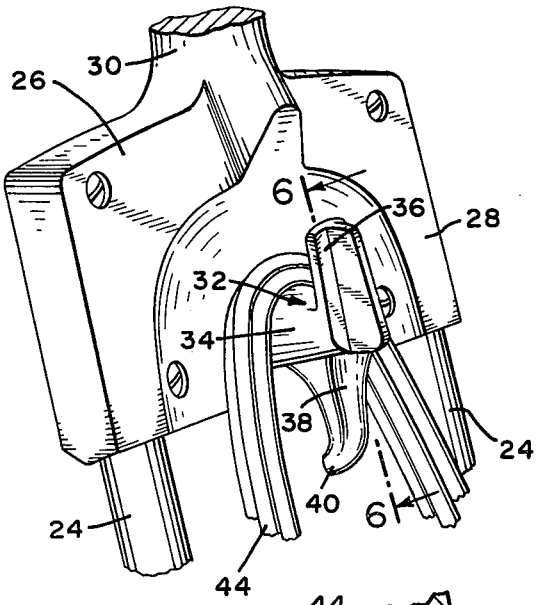
FIG. 4 is a perspective view on an enlarged scale of the upper compound hook in the position shown in FIG. 1.
Figure 6:
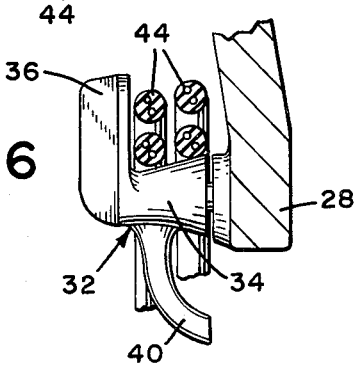
FIG. 6 is a cross-sectional view taken on the line 6—6 of FIG. 4.

However, when the compound hook is turned as just described to release the turns of the cord from arm 36, the other arm 38, as it moves from the downwardly extending position of FIGS. 4 and 6 to the upwardly extending position of FIGS. 5 and 7, catches and retains the first turn of the cord adjacent to portion 48. This results in the cord hanging freely from the upper part of handle 24, as shown in full lines in FIG. 2, rather than from the much lower point where the cord emerges from container 18, as shown in dotted lines in FIG. 2. It will be noted that the space between the curved end 40 of arm 38 and portion 28 when the arm extends upwardly is less than the diameter of cord 44 so that the latter cannot accidently be dislodged.

The outer surface of hook 38 should be convex, as best shown in FIGS. 6 and 7, so that as it is turned toward the upper position, the outer surface will have no tendency to engage and hold the turns being released from hook 36. On the contrary, the convex surface will displace the turns axially of the hub 34 and thus assure that they will fall free. As above explained, the first turn, adjacent to portion 28, will be picked up by the inner surface of hook 38 as the latter approaches the upper position.

When the cord hangs from the upper point, it usually contacts the surface 12 behind the feet of the operator as the latter moves the cleaner forwardly, as illustrated in full lines in FIG. 2, whereas if the cord were to hang free from the lower point, it would reach the surface 12 ahead of the operator's feet, as shown in broken lines in FIG. 2, where it would be in the way and apt to become entangled with the feet. It is not desirable to permanently secure the cord to the upper end of handle 24, as this would interfere with the removability of the latter from container 18.

While I have shown one more or less specific embodiment of my invention, it is to be understood that this has been done for the purpose of illustration only and is not to be considered as limiting the scope thereof which is to be determined by the appended claims.

I claim:

1. In an electrical appliance having an upwardly extending handle for propelling the appliance over a surface, an electric motor located near the lower portion of said appliance, an electric cord for supplying current to said motor, a member movably secured to the upper end of said handle, said member having a first arm of sufficient extent to retain, when said member is in a first position, all of the turns of said electric cord looped therearound, said member being movable to a second position in which said first arm releases all of said turns, and said member having a second shorter arm so positioned as to catch and retain the first turn only of the looped cord when said member is moved to said second position.

2. In a device as set forth in claim 1, a fixed downwardly facing hook extending from the lower portion of said appliance and so located with respect to said member that said cord may be wound around said fixed hook and said member when the latter is in said first position.

3. In a device as set forth in claim 1, said first arm being straight and extending substantially at right angles to the axis of rotation of said member and said second arm having its outer end curved toward said handle and when in said second position, spaced from said handle a distance less than the diameter of said cord.

4. In a device as set forth in claim 1, said handle being removable from the remainder of said appliance.

5. In a device as set forth in claim 1, said member having a hub portion extending at right angles to said handle to which it is rotatably secured, said first arm extending at right angles to said hub portion at the end thereof remote from said handle, and said second arm extending from an intermediate point of said hub and in a direction opposite to that of said first arm, said second arm being curved toward said handle and, when in said second position, terminating from said handle a distance less than the diameter of said cord.

6. In a device as set forth in claim 5, the surface of said second arm facing away from said handle being convex.

* * * * *